United States Patent [19]

Boldra

[11] Patent Number: 4,809,376

[45] Date of Patent: Mar. 7, 1989

[54] BEDDING WITH RETENTION POCKETS

[76] Inventor: Velta D. Boldra, 5405 Reynolds St., Omaha, Nebr. 68152

[21] Appl. No.: 167,957

[22] Filed: Mar. 14, 1988

[51] Int. Cl.[4] ..... A47G 9/02

[52] U.S. Cl. ..... 5/497; 5/485

[58] Field of Search ..... 5/497, 485, 495, 482, 5/499, 500, 502, 451

[56] References Cited

U.S. PATENT DOCUMENTS

| | | | |
|---|---|---|---|
| 2,569,627 | 10/1951 | Black . | |
| 2,598,141 | 5/1952 | Simpson | 5/497 |
| 2,630,588 | 3/1953 | Levin . | |
| 2,637,049 | 5/1953 | Kromer et al. . | |
| 3,114,156 | 12/1963 | Cobb . | |
| 3,996,633 | 12/1976 | Burke | 5/497 |
| 4,279,045 | 7/1981 | Vitale | 5/497 |
| 4,317,245 | 3/1982 | El-Amin | 5/497 |
| 4,338,693 | 7/1982 | Vitale | 5/497 |
| 4,486,909 | 12/1984 | McKneelan | 5/451 |

FOREIGN PATENT DOCUMENTS

| | | | |
|---|---|---|---|
| 2072007 | 9/1981 | United Kingdom | 5/500 |

*Primary Examiner*—Alexander Grosz

*Attorney, Agent, or Firm*—Zarley, McKee, Thomte, Voorhees & Sease

[57] ABSTRACT

Bedding retention pockets include four pockets attached to the bottom face of a sheet interiorly of the edges of the sheet, each pocket having and elongated band with one longitudinal edge attached to the sheet and curved to form a corner which will receive a corner of the mattress. A triangular bottom panel is attached along the other longitudinal edge of the band, parallel to the sheet, so as to form a pocket. The pocket is formed from a generally non-stretchable material to prevent the pockets from slipping off the corners of the mattress.

3 Claims, 3 Drawing Sheets

BEDDING WITH RETENTION POCKETS

TECHNICAL FIELD

This invention relates generally to pockets formed to encompass a corner of a mattress, and more particularly to pockets which are mounted upon a sheet to retain the sheet on a waterbed.

BACKGROUND OF THE INVENTION

The advent of the waterbed has also caused the rethinking of the manner in which bedding is attached thereto. It has long been a problem to maintain a sheet or mattress pad reasonably securely to the waterbed. To date, efforts have been made mainly in the direction of providing larger sheets, such that more material can be tucked between the mattress and the sides of the waterbed frame. Other efforts were directed to sheets having elastic strips attached thereto to tighten the edges of the sheet around the corners of the mattress.

However, the above described efforts have not met with total success. Sheets which extend on the side of the mattress are only held in position by the force of the water against the side frames. This force is not great enough to hold the sheets securely in position.

Efforts directed to larger sheets require the purchase of a complete set of new sheets. Other efforts have been directed to the use of fasteners to hold the sheet in place. However, such fasteners are typically cumbersome to operate and are not readily usable by one who does not possess the necessary manual dexterity.

Finally, sheets with elastic strips are inconvenient since the elastic will contract when not in use on the bed. This makes the sheet difficult to fold, and causes "puckering" along the edges. Furthermore, the biasing force of the elastic may cause the sheet to slip off the mattress, rather than securing the sheet in position.

It is therefore a general object of the present invention to provide an improved device for securing a sheet to a waterbed.

Another object is to provide corner pockets for attachment to the bottom of a conventional sheet, to retain the sheet in position on a waterbed mattress.

These and other objects will be apparent to those skilled in the art.

SUMMARY OF THE INVENTION

The bedding retention pockets of this invention include four pockets attached to the bottom face of a sheet interiorly of the edges of the sheet. Each pocket includes an elongated band having one longitudinal edge attached to the sheet and curved to form a corner which will receive a corner of the mattress. A triangular bottom panel is attached along the other longitudinal edge of the band, parallel to the sheet, so as to form a pocket. The corner of the waterbed mattress will fill in the pocket such that the triangular panel lies under the mattress, holding the pocket in position. A zigzag stitch secures the pocket to the sheet, and prevents unraveling. The pocket is formed from a generally non-stretchable material to prevent the pockets from slipping off the corners of the mattress, and eliminate other problems common to elastic strips and the like in prior art devices.

DESCRIPTION OF THE PREFERRED EMBODIMENT

Figure 1:
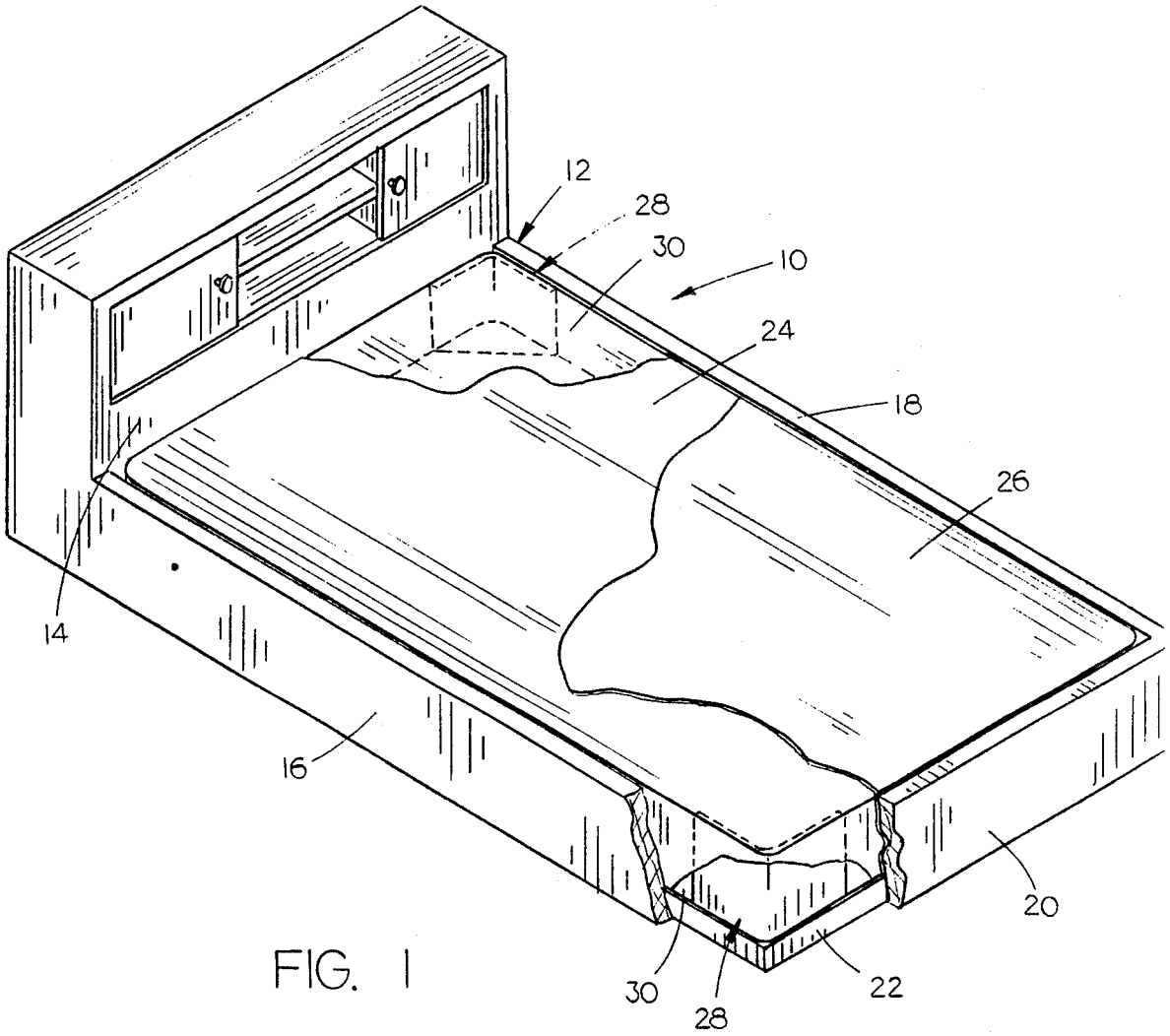
FIG. 1 is a perspective view of a waterbed with portions broken away in order to show the pocket portion of this invention.

Referring now to the drawings in which similar or corresponding parts are identified by the same reference numeral, and more particularly to FIG. 1, a waterbed is indicated generally at 10, and includes a frame 12 having a headboard 14, side frames 16 and 18, a footboard 20 and a mattress-supporting base 22. A conventional bottom sheet 24 and top sheet 26 are shown with portions cut away to show one of four retention pockets 28 of this invention positioned on a mattress 30. While the invention will be described with reference to sheets, the invention may similarly be utilized on mattress pads or any other bedding which is desired to be secured to a waterbed mattress.

Figure 2:
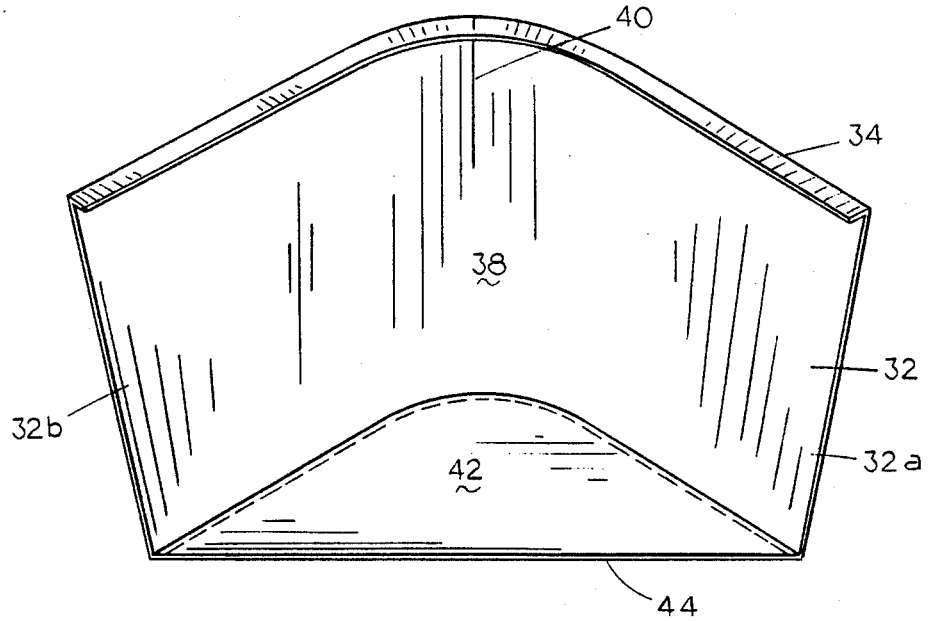
FIG. 2 is an enlarged perspective view of one retention pocket separate from the sheet.
Figure 3:
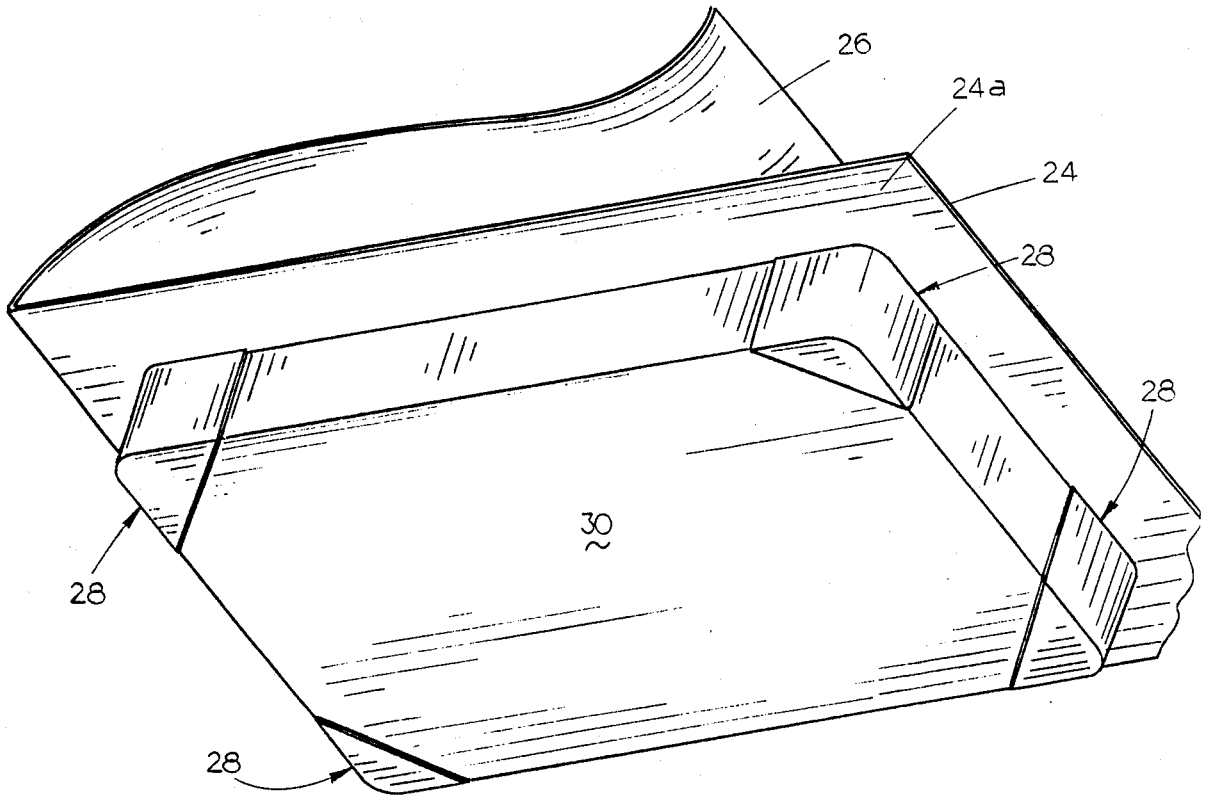
FIG. 3 is a perspective view of the underside of a mattress having a sheet with the pockets of this invention attached thereto.
Figure 4:
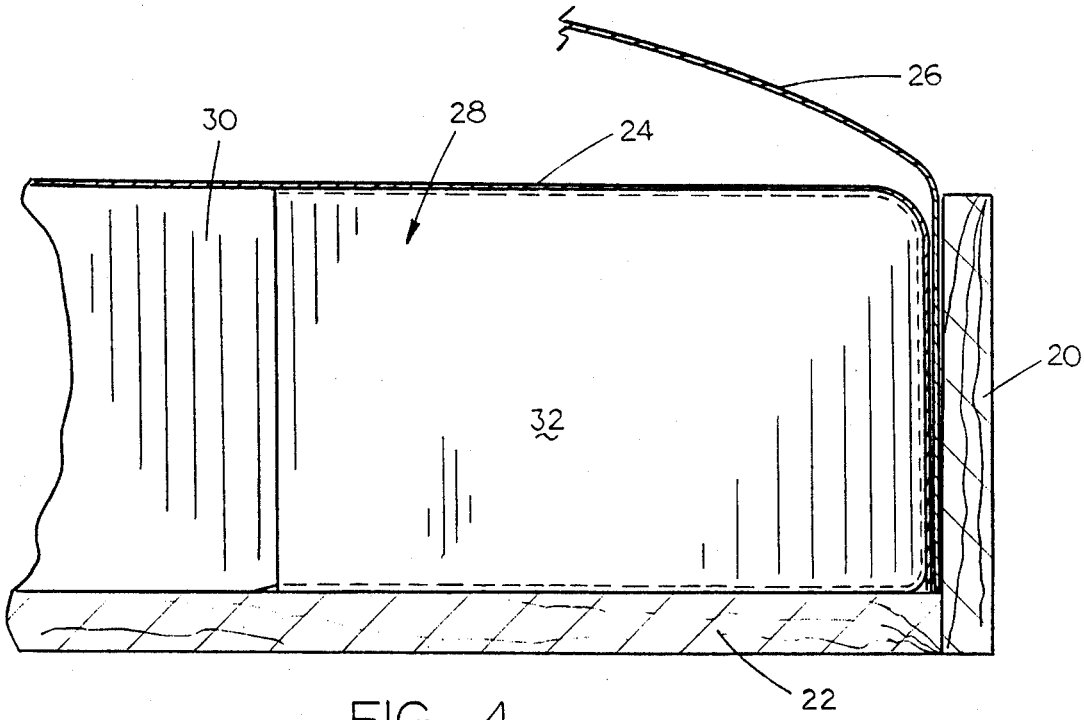
FIG. 4 is an enlarged partial side sectional view of rear corner of the sheet on a waterbed mattress.
Figure 5:
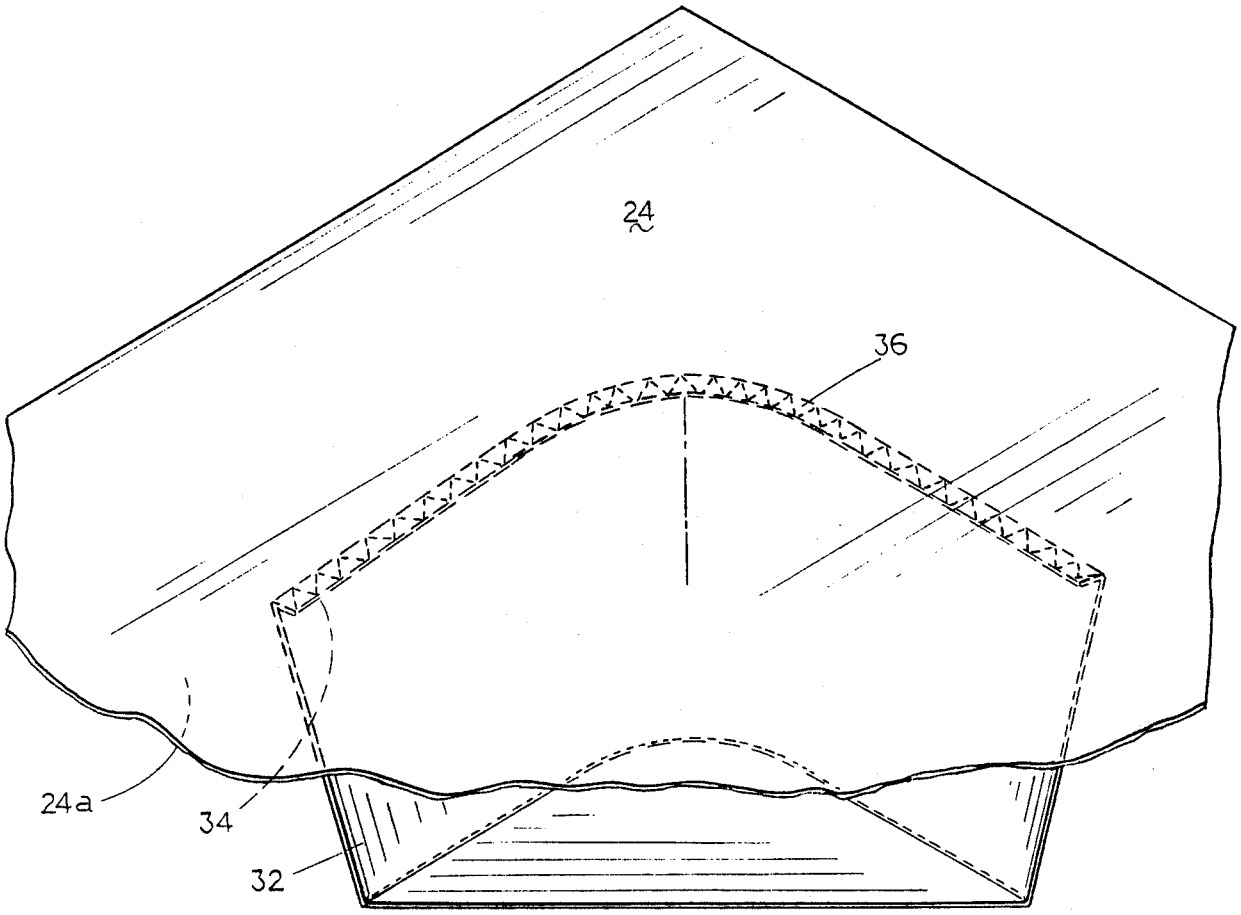
FIG. 5 is a partial perspective view of one corner of a sheet showing the pocket thereon.

FIG. 3 shows a view of the underside of the mattress 30 with the bed frame removed, for clarity. FIGS. 2 and 5 show one of the pockets 28 of the invention. Each pocket 28 includes an elongated, and generally rectangular band 32 with a small hem 34 along the upper longitudinal edge. Hem 34 is attached to the bottom face **24*a* of bottom sheet 24 with a zigzag stitch 36 to prevent unraveling. Band 32 is affixed in a generally vertical plane, and is curved near its middle 38 to form a corner which will follow the curved corners of a mattress 30. A pleat 40 extends downwardly from hem 34 and is centered in the curved portion 38. This allows the waterbed mattress to more naturally fill the pocket 28 and assist in holding the pocket 28** in position.

A triangular bottom panel 42 is attached along the lower longitudinal edge of band 32 with its base edge 44 connecting the ends **32*a* and 32*b* of band 32. The "height" of triangular panel 42, as measured perpendicularly from the center of the base edge 44 to the apex of the triangle, is preferred to be about ten and one-half inches, to form a pocket of sufficient depth to securely hold a sheet in position. For larger mattresses, it may be necessary to increase the depth of the pocket 28 by extending the length of band 32 and the "height" of bottom panel 42**.

As shown in FIG. 3, pockets 28 are affixed to the bottom side **24*a* of bottom sheet 24 inwardly of the edges to fit the mattress 30. The protruding edges of bottom sheet 24 are tucked between the frame 12 and mattress 30**.

Thus, a set of four pockets have been provided which are attached to a conventional sheet to secure the sheet to a waterbed mattress. The pockets 28 are formed of a non-stretchable material, such as muslin or cotton, to prevent the pockets 28 from slipping off the corners of the mattress, as was common with prior art bedding materials which utilized elastic bands or the like. Thus, this invention eliminates the need for elastic and the problems which go along with its use—replacement, shrinkage, puckering, etc. It can be seen that the invention fulfills at least all of the above stated objectives.

I claim:

1. Bedding with retention pockets for use on a waterbed mattress, the bedding including a bottom sheet, comprising:

pocket portions attached to the bottom face of said bottom sheet for receiving the corners of the mattress;

each said pocket portion including an elongated band of material oriented vertically and having an upper longitudinal edge attached to said bottom sheet, the band being curved near its middle to follow a corner of a waterbed mattress;

a generally triangular-shaped bottom panel having an arcuate apex portion, affixed to the lower edge of said band with said arcuate apex portion affixed along the curved portion of said band, parallel to the bottom sheet;

said band and bottom panel forming a pocket in conjunction with the bottom sheet, for receiving the corners of the waterbed mattress; and said band having a pleat extending downwardly from the upper longitudinal edge and centered in the curved portion thereof.

2. The retention pockets of claim 1, wherein said band includes a small hem extending along the upper longitudinal edge thereof, said hem being attached to said bottom sheet.

3. The retention pockets of claim 1, wherein said pocket portions are of a non-stretchable material.

* * * * *